US009650877B2

(12) United States Patent
Xue

(10) Patent No.: US 9,650,877 B2
(45) Date of Patent: May 16, 2017

(54) METHOD AND APPARATUS FOR IMPROVING STEAM DRYNESS OF STEAM INJECTION BOILER

(71) Applicant: SHANDONG HUAXI PETROLEUM TECHNOLOGY SERVICE CO., LTD., Shandong (CN)

(72) Inventor: Bingping Xue, Shandong (CN)

(73) Assignee: SHANDONG HUAXI PETROLEUM TECHNOLOGY, CO., LTD, Shandong (CN)

( * ) Notice: Subject to any disclaimer, the term of this patent is extended or adjusted under 35 U.S.C. 154(b) by 343 days.

(21) Appl. No.: 14/379,878

(22) PCT Filed: Jul. 4, 2013

(86) PCT No.: PCT/CN2013/078798
§ 371 (c)(1),
(2) Date: Aug. 20, 2014

(87) PCT Pub. No.: WO2014/026515
PCT Pub. Date: Feb. 20, 2014

(65) Prior Publication Data

US 2015/0308247 A1 Oct. 29, 2015

(30) Foreign Application Priority Data

Aug. 13, 2012 (CN) ..... 2012 1 02861415

(51) Int. Cl.
*B01F 3/04* (2006.01)
*E21B 43/24* (2006.01)
(Continued)

(52) U.S. Cl.
CPC ..... *E21B 43/24* (2013.01); *B01F 3/04099* (2013.01); *B01F 15/00123* (2013.01);
(Continued)

(58) Field of Classification Search
CPC ..... E21B 43/24; F22G 1/16; B01F 3/04099; B01F 15/00123; B01F 15/0261;
(Continued)

(56) References Cited

U.S. PATENT DOCUMENTS 4,442,898 A 4/1984 Wyatt
4,498,542 A * 2/1985 Eisenhawer ..... E21B 36/025 166/303
(Continued)

FOREIGN PATENT DOCUMENTS

CN 2358341 Y 1/2000
CN 2654854 Y 11/2004
(Continued)

*Primary Examiner* — Charles Bushey
(74) *Attorney, Agent, or Firm* — Andrew W. Chu; Craft Chu PLLC

(57) ABSTRACT

The method and an apparatus for improving the steam dryness of a steam injection boiler includes injecting wet saturated steam and gas into an oil layer together in a sealed way, after the dryness of the wet saturated steam at an outlet of the steam injection boiler is improved by a dryness raiser. The dryness raiser includes a combined spray head, a steam heating chamber, a combustion chamber, and a mixing chamber. The gas generated by the combustion chamber enters into the mixing chamber and is fully mixed with the steam from the steam injection boiler. The dryness of the wet saturated steam at the outlet of the steam injection boiler can be improved to 95%-100%, and the effects of improving steam enthalpy, replenishing stratum energy and enlarging the steam wave and size are realized, so as to heat up the oil layer more effectively, and improve heavy oil development.

10 Claims, 3 Drawing Sheets

(51) Int. Cl.

| | |
|---|---|
| ***F22G 1/16*** | (2006.01) |
| ***B01F 15/00*** | (2006.01) |
| ***B01F 15/02*** | (2006.01) |
| ***B01F 15/06*** | (2006.01) |

(52) U.S. Cl.
CPC ..... *B01F 15/0261* (2013.01); *B01F 15/063* (2013.01); *F22G 1/16* (2013.01); *B01F 2003/04936* (2013.01); *B01F 2003/04943* (2013.01); *B01F 2015/062* (2013.01)

(58) Field of Classification Search
CPC ..... B01F 15/063; B01F 2003/04936; B01F 2003/04943; B01F 2015/062

USPC ..... 261/141, DIG. 10, DIG. 76
See application file for complete search history.

(56) References Cited

U.S. PATENT DOCUMENTS

| | | | | |
|---|---|---|---|---|
| 5,509,478 | A * | 4/1996 | Stoy | E21B 43/24 166/250.06 |
| 7,028,478 | B2 * | 4/2006 | Prentice, III | F23G 5/006 60/645 |
| 7,966,977 | B2 * | 6/2011 | Schu | F01K 3/183 122/36 |
| 2012/0125610 | A1 * | 5/2012 | Prentice, III | E21B 43/2406 166/272.3 |
| 2013/0014950 | A1 * | 1/2013 | Dickinson | E21B 21/16 166/305.1 |

FOREIGN PATENT DOCUMENTS

| | | | |
|---|---|---|---|
| CN | 202216231 | U | 5/2012 |
| CN | 102818250 | A | 12/2012 |
| CN | 202852783 | U | 4/2013 |

* cited by examiner

METHOD AND APPARATUS FOR IMPROVING STEAM DRYNESS OF STEAM INJECTION BOILER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the technical domain of thermal recovery of heavy oil, in particular to a method and an apparatus for improving the steam dryness of a steam injection boiler, which can reduce thermal loss, improve dryness of injected steam, increase steam enthalpy, replenish stratum energy, and improve oil recovery rate.

2. Description of Related Art Including Information Disclosed Under 37 CFR 1.97 and 37 CFR 1.98.

Presently, the heavy oil recovery method mainly used in China and foreign countries is thermal recovery, which injects thermal energy into the oil layer, so as to increase oil layer temperature, decrease oil viscosity, improves oil fluidity, and attain the purpose of development and production. Steam generators (DC steam injection boilers) are of a specialized appliance commonly used for heavy oil recovery in China and foreign countries at present, and there are more than 2000 steam generators in China. The steam dryness is a key index that has influence on the steam injection and development effect. The higher the steam dryness is, the higher the steam enthalpy will be, the higher the oil volume swept by the steam in the oil reservoir will be, and the better the development effect will be. At present, limited by the structure of steam injection boiler and the quality of supplied water, the steam dryness at the outlet of steam injection boiler is only 70%-75%, and the steam dryness will be only 30%-40% when the steam is injected to the bottom of the well, owing to the thermal loss in the wellbore, causing severely degraded thermal recovery effect. To improve steam dryness, a superheated steam injection boiler is designed, with the following working principle: the steam at the outlet of a steam injection boiler enters into a spherical steam-water separator arrange outside of the boiler body for steam-water separation, the separated high-dryness steam is returned to a superheat section of the steam injection boiler and is heated up into superheated steam, the superheated steam flows through a spray-type desuperheater arranged outside of the boiler body and is mixed with the saturated brine separated from the spherical steam-water separator, so that the saturated water is vaporized to improve the dryness, and then is injected to the bottom of the well. Though that method avoids salt precipitation in the heat affected area and improves steam dryness, but the equipment has a complex structure and requires many auxiliary devices, and the control is complicated and the production cost is very high; if such boilers are used to substitute the existing steam injection boilers, the existing equipment will be wasted, and the investment is huge.

In addition, thermal recovery of heavy oil mainly employs steam huff-puff and steam flooding, and belongs to a pressure depletion process; as the huff-puff cycles increase and the steam flooding time extends, the stratum energy will become severely deficient, the development effect will be degraded, and the recovery rate will be decreased. The steam injection boiler can't solve the problem of stratum energy deficit in itself.

SUMMARY OF THE INVENTION

In view of the drawbacks described above in the prior art, the present invention provides a method and an apparatus for improving the steam dryness of a steam injection boiler, which can improve dryness of injected steam, increase steam enthalpy, replenish stratum energy, and improve oil recovery rate.

A method for improving the steam dryness of a steam injection boiler, comprising: improving the dryness of the wet saturated steam at the outlet of a steam injection boiler by means of a dryness raiser, and then injecting the saturated steam together with the gas generated by the dryness raiser into an oil layer in a sealed way;

wherein, the dryness raiser comprises a combined spray head, a steam heating chamber, a combustion chamber, and a mixing chamber; fuel oil and air are supplied into the combustion chamber by a high-pressure fuel oil pump and an air compressor under the control of an automatic control system of the dryness raiser, and are combusted in the combustion chamber; at the same time, the wet saturated steam at the outlet of the boiler enters into the steam heating chamber of the dryness raiser, and is heated up in the steam heating chamber by the high temperature created by the combustion in the combustion chamber; the high-temperature and high-pressure gas generated in the combustion chamber enters into the mixing chamber, and is fully mixed in the mixing chamber with the wet saturated steam with increased dryness from the steam heating chamber, so that the dryness of the wet saturated steam is further improved; by controlling the amount of fuel oil with the automatic control system of the dryness raiser, the dryness of the wet saturated steam can be improved to 95%-100%, the temperature of the gas and steam mixture can be controlled after mixing, and then the gas and steam mixture is injected into the oil layer through an steam injection string in a sealed way.

The steam heating chamber of the dryness raiser is arranged with a steam inlet on its head end and an annular multi-orifice nozzle on its tail end, the tail end of the combustion chamber communicates with the annular multi-orifice nozzle on the tail end of the steam heating chamber, and communicates with the mixing chamber.

The mixing chamber of the dryness raiser is arranged with an additional steam inlet on its upper end; one branch of the steam supplied from the steam injection boiler enters into the steam heating chamber through the steam inlet on the head end of the steam heating chamber, and the other branch of the steam supplied from the steam injection boiler enters into the mixing chamber directly through the additional steam inlet of the mixing chamber.

The combustion chamber of the dryness raiser is arranged with a preheating chamber at its head end, and the fuel oil and air are preheated in the preheating chamber, to facilitate the combustion of the fuel oil in atomized state.

The apparatus for improving the steam dryness of a steam injection boiler disclosed in the present invention comprises a high-pressure fuel oil pump, an air compressor, a dryness raiser, and an automatic control system of the dryness raiser; one steam branch of the steam outlet of the steam injection boiler is connected through an oil injection pipe to an automatic control bypath valve, and connected directly through the automatic control bypath valve to a steam injection well mouth; the other steam branch of the steam outlet is connected through an automatic control valve of the steam inlet to the dryness raiser, the steam dryness is further improved by the dryness raiser, and then the steam is injected into the steam injection well mouth; the automatic control system of the dryness raiser is connected with an automatic control system of the steam injection boiler; the high-pressure fuel oil pump, the air compressor, and an igniter arranged on the dryness raiser are connected to the automatic control system of the dryness raiser; the high-pressure fuel oil pump and the air compressor are connected to a high-pressure fuel oil nozzle and a high-pressure air nozzle on the dryness raiser respectively; an gas-steam outlet of the dryness raiser is connected through an automatic control valve of the gas-steam outlet and a check valve to the steam injection well mouth.

The dryness raiser described in the present invention comprises a combined spray head, a steam heating chamber, a combustion chamber, and a mixing chamber, wherein, the combined spray head has a high-pressure air nozzle, an igniter, and a high-pressure fuel oil nozzle, and is connected to the combustion chamber; the combustion chamber is in a cylindrical structure; the steam heating chamber is fitted over the combustion chamber in a circular form, and has a steam inlet on its head end and an annular multi-orifice nozzle on its tail end; the tail end of the combustion chamber communicates with the annular multi-orifice nozzle on the tail end of the steam heating chamber, and communicates with the mixing chamber; the mixing chamber has a gas-steam outlet on its outlet end.

Alternatively, the dryness raiser described in the present invention can be in the following structure: the dryness raiser comprises a combined spray head, a steam heating chamber, a combustion chamber, and a mixing chamber, wherein, the combined spray head has a high-pressure air nozzle, an igniter, and a high-pressure fuel oil nozzle, and is connected to the combustion chamber; the combustion chamber is in a cylindrical structure; the steam heating chamber is fitted over the combustion chamber in a circular form, and has a steam inlet on its head end; the tail end of the combustion chamber communicates with the tail end of the steam heating chamber, and communicates with the mixing chamber; the mixing chamber has a steam inlet on its upper end and a gas-steam outlet on its outlet end.

Alternatively, the dryness raiser described in the present invention can be in the following structure: according to the properties of the fuel oil, a preheating chamber is arranged at the head end of the combustion chamber of either dryness raiser described above, to facilitate combustion of the fuel oil in atomized state, wherein, the preheating chamber is connected to the combined spray head, the preheating chamber and the combustion chamber are an integral cylindrical structure, the preheating chamber has holes arranged opposite to each other on its top side and bottom side, and the high-pressure air nozzle, igniter, and high-pressure fuel oil nozzle communicate with the combustion chamber through the preheating chamber.

The preheating chamber, annular multi-orifice nozzle, steam inlet of mixing chamber, and mixing chamber involved in the above schemes of dryness raiser can be used fully or partially in the dryness raiser, according to the specific conditions of implementation; for example, the preheating chamber can be used or not used, according to the properties of the fuel oil; either the annular multi-orifice nozzle on the tail end of the steam heating chamber or the steam inlet of the mixing chamber can be used, or both of them can be used, or neither of them is used if the volume of the mixing chamber is large enough; of course, the mixing chamber can be used or not used, depending on the distance to the well mouth; in addition, in the present invention, the fuel is not limited to fuel oil; for example, fuel gas can be used as the fuel, of course, in that case, a high-pressure fuel gas pump should be used accordingly; in summary, any ordinary structural variation of such components shall be deemed as falling in the protected domain of the present invention.

The structural variations of the dryness raiser include, but are not limited to the forms described above.

Compared to the prior art, the present invention has the following advantages:

1. The method and apparatus can effectively improve the steam dryness of wet saturated steam at the outlet of the steam injection boiler from 70%-75% to 95%-100%, and increase steam enthalpy, so that the oil layer can be heated more effectively, and the heavy oil development effect can be improved;

2. The high-temperature and high-pressure gas generated with the method and apparatus is injected together with the steam with improved dryness into the oil layer; thus, the thermal energy loss is reduced, the thermal utilization ratio of energy is improved, and the environmental pollution resulted from emission of carbon dioxide can be avoided;

3. The high-temperature and high-pressure gas generated with the method and apparatus contains nitrogen (80%) and carbon dioxide (20%), which can effectively supplement the stratum energy and enlarge the swept volume of the steam, wherein, the carbon dioxide gas can effectively change the fluidity of oil reservoir and attain an effect of decreasing viscosity and pour point; thus, the heavy oil recovery rate can be improved;

4. The method and apparatus implement reasonable design and compact conformation, and can be used easily with the existing steam injection boilers for mobile operation; utilizing the existing steam injection boiler, the steam dryness in thermal recovery of heavy oil can be improved and an effect of supercharged recovery can be obtained, without investment in a new superheated steam injection boiler; thus, the recovery cost can be decreased and the oil reservoir recovery rate can be improved effectively.

Among the drawings: 1—steam injection boiler, 2—automatic control valve of steam outlet of boiler, 3—automatic control valve of steam inlet, 4—dryness raiser, 5—discharge valve, 6—automatic control valve of gas-steam outlet, 7—check valve, 8—automatic control bypass valve, 9—automatic control system of steam injection boiler, 10—automatic control system of dryness raiser, 11—fuel oil tank, 12—high-pressure fuel oil pump, 13—air compressor, 14—steam injection well mouth, 4.1—steam inlet, 4.2—steam heating chamber, 4.3—combustion chamber, 4.4—combined spray head, 4.5—high-pressure air nozzle, 4.6—igniter, 4.7—high-pressure fuel oil nozzle, 4.8—preheating chamber, 4.9—annular multi-orifice nozzle, 4.10—mixing chamber, 4.11—gas-steam outlet, 4.12—steam inlet of mixing chamber.

DETAILED DESCRIPTION OF THE DRAWINGS

Figure 1:
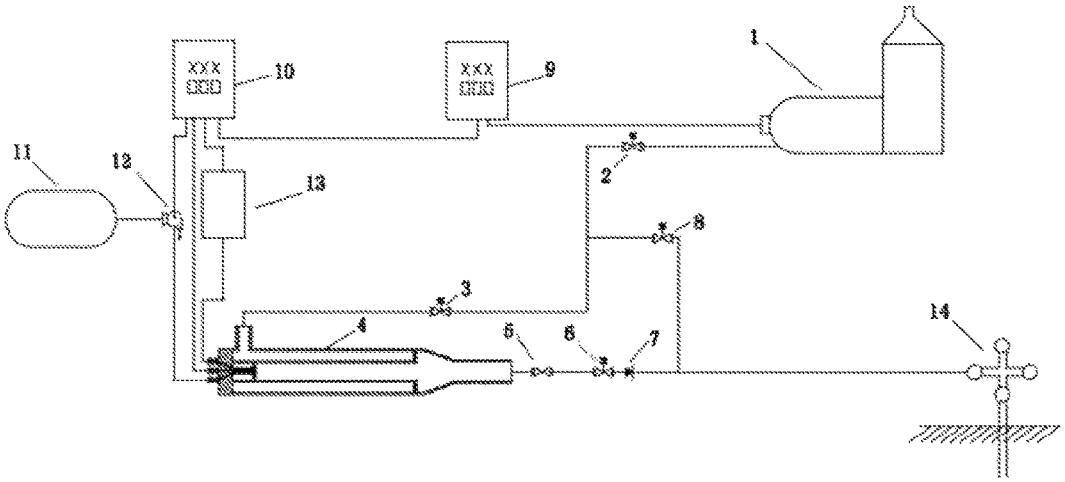
FIG. 1 is a flow chart of a processing apparatus that utilizes the method disclosed in the present invention.
Figure 2:
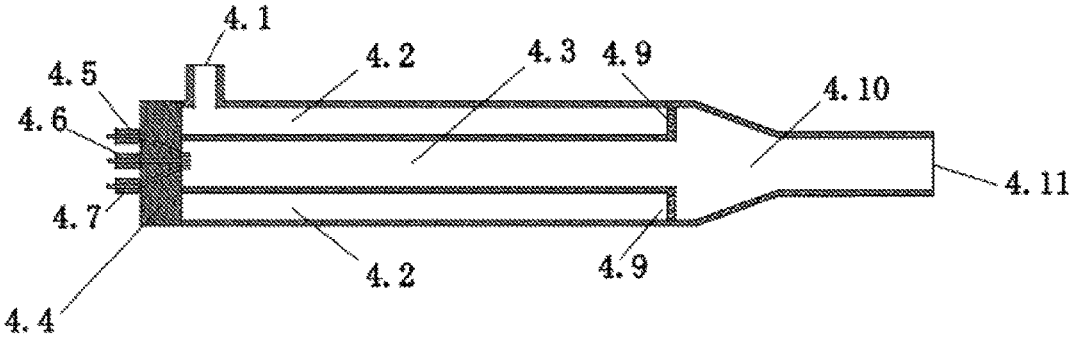
FIG. 2 is a schematic view of a diagram of a first structural implementation of the dryness raiser.

Embodiment 1: Hereunder the present invention will be further detailed with reference to FIG. 1 and FIG. 2:

The present invention utilizes the principles in combustion, hydrodynamics, heat transfer, and engineering thermodynamics with engineering technology in combination, and designs a method that utilizes a developed dryness raiser to heat up the wet saturated steam with 70%-75% dryness at the outlet of a steam injection boiler and improve the dryness to 95%-100%, and then injects the saturated steam with improved dryness into the oil layer through an steam injection string together with gas in a sealed way. The apparatus mainly comprises a steam injection boiler 1, a dryness raiser 4, a high-pressure fuel oil pump 12, an air compressor 13, and an automatic control system 10 of the dryness raiser. The steam outlet of the steam injection boiler is connected to an automatic control valve 3 and an automatic control bypass valve 8 at the steam inlet of the dryness raiser 4 through a steam injection pipe; the automatic control system 9 of the steam injection boiler is connected with the automatic control system 10 of the dryness raiser, wherein, the automatic control system 9 of the steam injection boiler and the automatic control system 10 of the dryness raiser are implemented with known techniques in the prior art, and therefore will not be detailed here; the high-pressure fuel oil pump 12, air compressor 13, igniter 4.6 are connected to the automatic control system 10 of the dryness raiser; the high-pressure fuel oil pump 12 and the air compressor 13 are connected to a high-pressure fuel oil nozzle 4.7 on a combined spray head 4.4 and a high-pressure air nozzle 4.5 arranged of the dryness raiser respectively; a gas-steam outlet 4.11 arranged on the dryness raiser 4 is connected to a discharge valve 5, an automatic control valve 6 of the gas-steam outlet, and a check valve 7, and the check valve 7 is connected to a steam injection well mouth 14.

The method is implemented as follows: first, the steam injection boiler 1 is started, with the automatic control valve 3 of the steam inlet and the automatic control valve 6 of the gas-steam outlet of the dryness raiser in closed state, and the automatic control valve 2 and automatic control bypass valve 8 of the steam outlet of the boiler in open state, and, in that state, the steam generated by the steam injection boiler is injected into the oil well through the automatic control bypass valve 8; after the parameters of the steam injection boiler become normal, the dryness raiser 4 is started, and the automatic control valve 3 and discharge valve 5 of the steam inlet of the dryness raiser are opened and the automatic control bypass valve 8 is closed at the same time, so that the dryness raiser 4 operates with preset working parameters, and the fuel oil in a fuel tank 11 and compressed air are supplied by the high-pressure fuel oil pump 12 and air compressor 13 to the dryness raiser 4 under the control of the automatic control system; the fuel oil and air enters into the combustion chamber 4.3 of the dryness raiser 4, ignited by the igniter 4.6 and combusted; when the combustion is detected by 20 s automatic detection as normal, the automatic control valve 6 of the gas-steam outlet is opened automatically and the discharge valve 5 is closed under program control, so that the dryness raiser 4 in normal operation state improves the dryness of the wet saturated steam with 70%-75% dryness supplied from the steam injection boiler to 95%-100%, and then the wet saturated steam with improved dryness is injected together with the gas into the oil layer through a steam injection string in a sealed way.

If the dryness raiser 4 is detected as by 20 s automatic detection as failed or abnormal after it is started, the high-pressure fuel oil pump 12 and air compressor 13 will be shut off automatically, and the automatic control valve 3 of the steam inlet and the automatic control valve 6 of the gas-steam outlet will be closed and the discharge valve 5 and automatic control bypass valve 8 will be opened at the same time; in addition, the failure point will be displayed on the display screen of a monitoring and control system. The restart procedure is the same as the procedure described above. The steam heating chamber 4.2 around the combustion chamber 4.3 is heated by the approx. 2000° C. high temperature created by the combustion in the combustion chamber 4.3, the saturated water in the wet saturated steam absorbs heat and is vaporized in the steam heating chamber 4.2, so that the steam dryness is improved; the saturated water cools the outer wall of the combustion chamber 4.3 as it absorbs heat and is vaporized, because the saturated water has high latent heat of vaporization and the vapor temperature remains unchanged in the heat absorption and vaporization process of the saturated water; therefore, the temperature of the outer wall of the combustion chamber 4.3 will not be too high, and the combustion chamber 4.3 of the dryness raiser 4 will not be ablated, which is to say, the combustion chamber 4.3 can operate safely in a long time. The wet saturated steam with improved dryness is sprayed by the annular multi-orifice nozzle 4.9 on the tail end of the steam heating chamber 4.2 into the mixing chamber 4.10, and is fully mixed with the high-temperature and high-pressured gas generated in the combustion chamber 4.3, most of the saturated water is vaporized instantly under the heat, and the steam dryness is further improved in the mixing chamber 4.10, for example, to 95%-100%, depending on the volume of fuel oil used. In addition, the temperature of the gas-steam mixture can be controlled, and then the gas-steam mixture is injected into the oil layer through the gas-steam outlet 4.11 and a steam injection string. The design parameters and working parameters of the dryness raiser 4 are displayed on the display screen of an automatic control system in real time and are stored automatically.

The dryness raiser mainly comprises a combined spray head 4.4, a steam heating chamber 4.2, a combustion chamber 4.3, and a mixing chamber 4.10, wherein, the combined spray head 4.4 has a high-pressure air nozzle 4.5, an igniter 4.6, and a high-pressure fuel oil nozzle 4.7, and is connected to the combustion chamber 4.3; the combustion chamber 4.3 is in a cylindrical structure; the steam heating chamber 4.2 is fitted over the combustion chamber 4.3 in a circular form, and has a steam inlet 4.1 on its head end and an annular multi-orifice nozzle 4.9 on its tail end; the tail end of the combustion chamber 4.3 communicates with the annular multi-orifice nozzle 4.9 on the tail end of the steam heating chamber 4.2, and communicates with the mixing chamber 4.10; the mixing chamber 4.10 has a gas-steam outlet 4.11 on its outlet end, and the gas-steam outlet 4.11 is connected through a discharge valve 5, a gas-steam automatic control valve 6, and a check valve 7 to a steam injection string.

Figure 3:
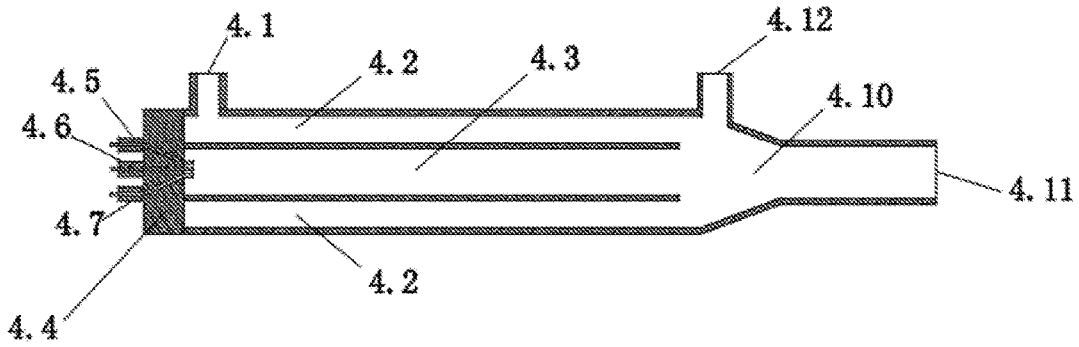
FIG. 3 is a schematic view of a diagram of a second structural implementation of the dryness raiser.

Embodiment 2:

Embodiment 1: Hereunder the present invention will be further detailed with reference to FIG. 1 and FIG. 3:

The difference between this embodiment and embodiment 1 is: the annular multi-orifice nozzle 4.9 on the tail end of the steam heating chamber 4.2 of the dryness raiser 4 is omitted, and an additional steam inlet 4.12 is arranged on the upper end of the mixing chamber 4.10; one branch of steam supplied from the steam injection boiler enters into the steam heating chamber 4.2 through the steam inlet 4.1, and the other branch of steam supplied from the steam injection boiler directly enters into the mixing chamber 4.10. With this scheme, the gas and steam can be fully mixed, the steam dryness can be improved to 95%-100%, and the object of the present invention can also be attained.

Figure 4:
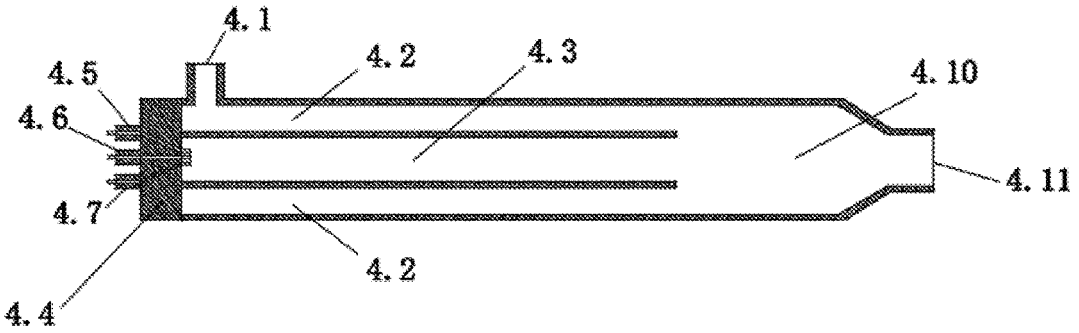
FIG. 4 is a schematic view of a diagram of a third structural implementation of the dryness raiser.
Figure 5:
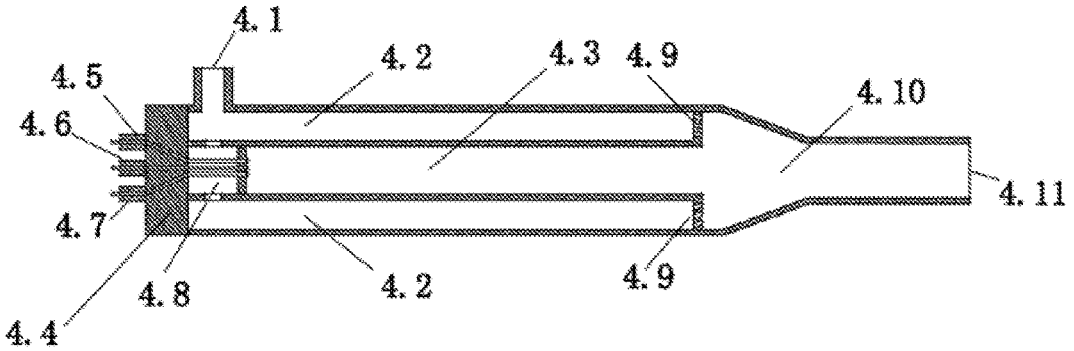
FIG. 5 is a schematic view of a diagram of a fourth structural implementation of the dryness raiser.
Figure 6:
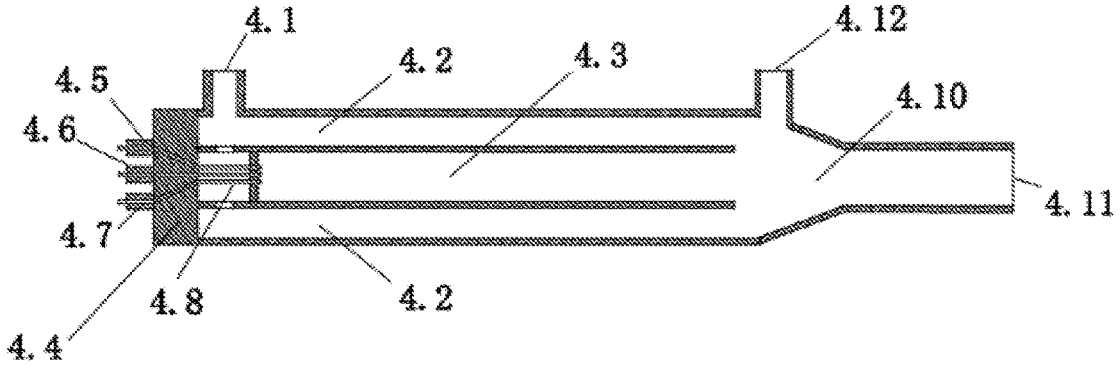
FIG. 6 is a schematic view of a diagram of a fifth structural implementation of the dryness raiser.
Figure 7:
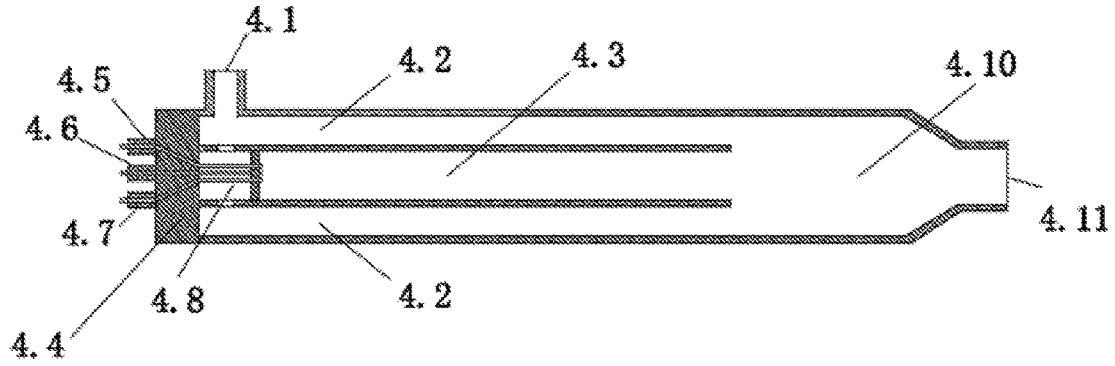
FIG. 7 is a schematic view of a diagram of a sixth structural implementation of the dryness raiser.

Embodiment 3:

Embodiment 1: Hereunder the present invention will be further detailed with reference to FIG. 1 and FIG. 4:

The difference between this embodiment and embodiment 1 is: the annular multi-orifice nozzle 4.9 on the tail end of the steam heating chamber 4.2 of the dryness raiser 4 is omitted, and the mixing chamber 4.10 is extended outwards to enlarge its volume, so that the gas from the combustion chamber can be fully mixed with the steam from the steam injection boiler and the steam dryness can be improved to 95%-100%; of course, the mixing chamber can be in a horn shape, cone shape, or cylinder shape, not limited to the structure illustrated in the drawings. With this scheme, the gas and steam can also be mixed fully, and the object of the present invention can also be attained.

Embodiment 4:

Embodiment 1: Hereunder the present invention will be further detailed with reference to FIG. 1, FIG. 5, FIG. 6, and FIG. 7:

The difference between this embodiment and embodiment 1 is: a preheating chamber 4.8 is arranged at the head end of the combustion chamber 4.3 of the dryness raiser 4, according to the properties of the fuel; other structural changes can also be implemented in this embodiment, similar to the case of embodiment 2 or embodiment 3. The object of the present invention can also be attained with this scheme.

The preheating chamber 4.8, annular multi-orifice nozzle 4.9, steam inlet 4.12 of mixing chamber, and mixing chamber 4.10 involved in the above schemes of the dryness raiser 4 can be used fully or partially in the dryness raiser 4, according to the specific conditions of implementation; for example, the preheating chamber 4.8 can be used or not used, according to the properties of the fuel oil; either the annular multi-orifice nozzle 4.9 on the tail end of the steam heating chamber 4.2 or the steam inlet 4.12 of the mixing chamber can be used, or both of them can be used, or neither of them is used if the volume of the mixing chamber 4.2 is large enough; of course, the mixing chamber 4.10 can be used or not used, depending on the distance to the well mouth; in addition, in the present invention, the fuel is not limited to fuel oil; for example, fuel gas can be used as the fuel, of course, in that case, a high-pressure fuel gas pump and a fuel gas pipeline instead of a fuel oil tank should be used accordingly; such structures are well-known by those skilled in the art.

The structural variations of the dryness raiser 4 include, but are not limited to the forms described in above embodiments and illustrated in the accompanying drawings, and any ordinary structural variation shall be deemed as falling in the protection domain of the present invention.

I claim:

1. A method for improving steam dryness of a steam injection boiler, comprising the steps of:

setting dryness of wet saturated steam at an outlet of a steam injection boiler by a dryness raiser; and injecting the saturated steam together with gas generated by said dryness raiser into an oil layer in a sealed way;

wherein said dryness raiser comprises:

a combined spray head, a steam heating chamber, a combustion chamber, and a mixing chamber, wherein fuel oil and air are supplied into said combustion chamber by a fuel oil pump and an air compressor under control of an automatic control system of said dryness raiser, wherein fuel oil and air are combusted in said combustion chamber, wherein said wet saturated steam at said outlet of said boiler enters into said steam heating chamber of said dryness raiser (4) at a same time as said fuel oil and air are combusted, wherein said wet saturated steam is heated in said steam heating chamber by heat created by combustion in said combustion chamber, wherein gas generated in said combustion chamber enters into said mixing chamber, and mixes in said mixing chamber with said wet saturated steam with increased dryness from said steam heating chamber, and wherein dryness of the wet saturated steam is further improved by controlling an amount of fuel oil with said automatic control system, dryness of said wet saturated steam being improved to 95%-100%, a temperature of a gas-steam mixture being controlled after mixing, said gas-steam mixture being injected into said oil layer through a steam injection string in a sealed way.

2. The method for improving the steam dryness of a steam injection boiler according to claim 1, further comprising the following steps:

starting up a steam injection boiler with an automatic control valve of a steam inlet, an automatic control valve of a gas-steam outlet in closed state, an automatic-control valve, and an automatic-control bypass valve of the steam outlet of the boiler in open state, wherein steam generated by said steam injection boiler is injected through the automatic control bypass valve into an oil well; and after parameters of said steam injection boiler become normal, starting said dryness raiser, opening said automatic control valve and a discharge valve of the steam inlet, closing said automatic control bypass valve, operating said dryness raiser with preset working parameters, and controlling the fuel oil pump and air compressor with said automatic control system of said dryness raiser to supply the fuel oil in a fuel oil tank and compressed air to said dryness raiser, wherein fuel oil and air enter into the combustion chamber, ignite by an igniter, and are combusted in said combustion chamber, wherein, when combustion is detected as normal, said automatic control valve of said gas-steam outlet opens and said discharge valve closes, said dryness raiser in normal operation state improving dryness of the wet saturated steam supplied from the steam injection boiler to 95%-100%, and wherein said wet saturated steam with improved dryness is mixed with gas generated from combustion in said dryness raiser and then injected together with said gas into said oil layer through a steam injection string in a sealed way.

3. The method for improving the steam dryness of a steam injection boiler according to claim 1, wherein said steam heating chamber is arranged with a steam inlet on a head end thereof and an annular multi-orifice nozzle on a tail end thereof, and wherein said tail end of said combustion chamber communicates with the annular multi-orifice nozzle on said tail end of said steam heating chamber and the mixing chamber.

4. The method for improving the steam dryness of a steam injection boiler according to claim 1, wherein said mixing chamber is provided with an additional steam inlet on an upper end thereof, wherein a branch of the steam supplied from said steam injection boiler enters into said steam heating chamber through said steam inlet on said head end of said steam heating chamber, and wherein another branch of steam supplied from said steam injection boiler enters into said mixing chamber directly through said steam inlet of said mixing chamber.

5. The method for improving the steam dryness of a steam injection boiler according to claim 1, wherein said combustion chamber is arranged with a preheating chamber at a head end thereof, and wherein fuel oil and air are preheated in the preheating chamber, facilitating combustion of the fuel oil in atomized state.

6. An apparatus for improving steam dryness, said apparatus, comprising:

a steam injection boiler having a steam outlet with a steam branch connected through an oil injection pipe to an automatic control bypath valve and being in fluid connection with a steam injection well mouth through said automatic control bypath valve;

a dryness raiser having an automatic control valve of said steam inlet in fluid connection with said steam injection boiler through said oil injection pipe, said automatic control bypath valve and said automatic control valve of said steam so as to set dryness of wet saturated steam of said steam injection boiler by said dryness raiser and to inject the saturated steam into said oil layer according to claim 1;

an automatic control system being connected to said dryness raiser:

an automatic control system of said steam injection boiler being connected to said steam injection boiler and said automatic control system;

a fuel oil pump being connected to said automatic control system;

an air compressor being connected to said automatic control system;

an automatic control valve of a gas-steam outlet in fluid connection with said dryness raiser and said steam injection well mouth; and a check valve in fluid connection with said automatic control valve of said gas-steam outlet, wherein said dryness raiser is comprised of a fuel oil nozzle and an air nozzle, said fuel oil pump being connected to said fuel oil nozzle, said air compressor being connected to said air nozzle, wherein said dryness raiser is comprised of a gas-steam outlet, said automatic control valve of gas-steam outlet and said check valve being in fluid connection to said steam injection well mouth through said gas-steam outlet, wherein said dryness raiser is comprised of a combined spray head, a steam heating chamber, a combustion chamber, and a mixing chamber, wherein a supply of fuel oil from said fuel oil pump and said combustion chamber is determined by said automatic control system, a supply of air from said air compressor and said combustion chamber being determined by said automatic control system so as to combust said fuel oil and said air in said combustion chamber and so as to produce gas, wherein said wet saturated steam from said steam injection boiler enters into said steam heating chamber through said automatic control bypath valve so as to heat said wet saturated steam when said fuel oil and said air combust in said combustion chamber and so as to produce a heated wet saturated steam with increased dryness compared to said wet saturated steam, and wherein said gas and said heated wet saturated steam from said steam heating chamber enter into said mixing chamber, said mixing chamber being in fluid connection with said gas-steam outlet so as to form a gas-steam mixture to be injected into said oil layer.

7. The apparatus for improving the steam dryness, according to claim 6, wherein said dryness raiser further comprises:

a combined spray head having an air nozzle, an igniter, and a fuel oil nozzle and being connected to said combustion chamber, said combustion chamber being cylindrical; and a steam heating chamber being fitted over said combustion chamber in a circular form and having a head end with a steam inlet and a tail end with an annular multi-orifice nozzle; and wherein said combustion chamber has a tail end in communication with said annular multi-orifice nozzle and said mixing chamber, said mixing chamber having an outlet end in fluid connection with said gas-steam outlet.

8. The apparatus for improving the steam dryness, according to claim 6, wherein said dryness raiser comprises:

a combined spray head having an air nozzle, an igniter, and a fuel oil nozzle and being connected to said combustion chamber, said combustion chamber being cylindrical; and a steam heating chamber being fitted over said combustion chamber in a circular form and having a head end with a steam inlet and a tail end; and wherein said combustion chamber has a tail end in communication with said tail end of said steam heating chamber and said mixing chamber, said mixing chamber having an upper end and an outlet end in fluid connection with said gas-steam outlet.

9. The apparatus for improving steam dryness, according to claim 7, wherein said dryness raiser is further comprised of a preheating chamber, wherein said combustion chamber has a head end, said preheating chamber being arranged on said head end of said combustion chamber, wherein said preheating chamber is connected to said combined spray head, wherein said preheating chamber and said combustion chamber are comprised of an integral cylindrical structure, said preheating chamber having a top side and a bottom side, said preheating chamber being comprised of holes arranged opposite to each other on said top side and said bottom side, and wherein said air nozzle, igniter, and fuel oil nozzle communicate with said combustion chamber through said preheating chamber.

10. The apparatus for improving steam dryness according to claim 8, wherein said dryness raiser is further comprised of a preheating chamber, wherein said combustion chamber has a head end, said preheating chamber being arranged on said head end of said combustion chamber, wherein said preheating chamber is connected to said combined spray head, wherein said preheating chamber and said combustion chamber are comprised of an integral cylindrical structure, said preheating chamber having a top side and a bottom side, said preheating chamber being comprised of holes arranged opposite to each other on said top side and said bottom side, and wherein said air nozzle, igniter, and fuel oil nozzle communicate with said combustion chamber through said preheating chamber.

* * * * *